US005594194A

United States Patent [19]

Steward et al.

[11] Patent Number: 5,594,194

[45] Date of Patent: Jan. 14, 1997

[54] DUAL-AXIS AMMUNITION REORIENTER

[75] Inventors: Anthony R. Steward, Essex Junction; Peter A. Bates, Underhill, both of Vt.

[73] Assignee: Martin Marietta Corporation, Bethesda, Md.

[21] Appl. No.: 432,558

[22] Filed: May 1, 1995

[51] Int. Cl.[6] ..... F41A 9/11

[52] U.S. Cl. ..... 89/46; 89/33.01

[58] Field of Search ..... 89/46, 33.01

[56] References Cited

U.S. PATENT DOCUMENTS 4,759,254 7/1988 Zielinski ..... 89/24

4,947,728 8/1990 Mühlhausen et al. ..... 89/46

5,054,367 10/1991 Heldmann et al. ..... 89/46

*Primary Examiner*—J. Woodrow Eldred

*Attorney, Agent, or Firm*—Robert A. Cahill; Geoffrey H. Krauss

[57] ABSTRACT

An ammunition round reorienter is equipped with a gear train having parallel drive paths connecting a common motor to concurrently rotate a platform about a vertical axis and to pivot a tray about a horizontal axis, such that an ammunition round carried by the tray is reoriented both in azimuth and elevation as it is translated between receiving and handoff orientations.

14 Claims, 2 Drawing Sheets

DUAL-AXIS AMMUNITION REORIENTER

FIELD OF THE INVENTION

The present invention relates to ammunition handling equipment and particularly to an ammunition reorienter utilized in automated loading systems for tank howitzers.

BACKGROUND OF THE INVENTION

Future requirements for military fighting vehicles, such as tanks, call for an unparalleled combination of fire power and protection integrated into a highly mobile and transportable vehicle of lower weight and reduced signature size. To meet these requirements, all systems must be compact and lightweight and capable of being packaged in a fighting vehicle with minimal consumption of space.

One system that has been particularly challenged to meet stringent space requirements is the armament system, particularly the ammunition handling aspects of the armament system. Ammunition rounds for the tank howitzer must be stored in a safe and secure manner to withstand travel over rough terrain. Typically, the howitzer rounds are stored in one or more magazines located in the tank hull and/or turret bustle. The magazines must be designed to optimize storage density, thereby maximizing storage capacity consistent with available space that is not abundant. In the past, the task of retrieving rounds from the magazine(s) and loading them into the tank howitzer was performed manually. Thus, considerable space within the tank hull and turret had to be allotted to accommodate body movements of a tank crew member necessary to retrieve and load the howitzer rounds. Also, such manual handling of howitzer rounds is not conducive to rapid fire action of the cannon in battle and jeopardizes the safety of the ammunition handling crew member.

To save at least some of the space required for the manual handling of howitzer ammunition, automated ammunition loading systems have been proposed and developed. Such autoloading systems successively retrieve howitzer rounds from a magazine(s) and load them into the tank howitzer without intervention by a tank crew member. This autoloading approach to serving the tank howitzer achieves a rapid firing rate and enhances crew safety.

One of the crucial aspects of an autoloading system is the interface between the ammunition magazine and the autoloader. Typically, the large caliber ammunition rounds successively downloaded from the magazine are not in the proper orientation for handoff to the loading arm of an autoloader. Consequently, a "tip tray" is utilized to reorient each ammunition round as received from the magazine downloading port to an orientation acceptable to the loading arm. In the past, reorientation in either azimuth or elevation was all that was required. However, in future military tank designs, the space available for ammunition round reorientation will be severely limited. Consequently, the reorienting motion will be required to follow a complex path that avoids all static and dynamic structures within the close confines of the tank.

SUMMARY OF THE INVENTION

It is accordingly an objective of the present invention to provide an improved reorienter capable of translating a large caliber round of ammunition along a complex reorientation path between a received orientation and a handoff orientation.

To achieve this objective, the ammunition round reorienter of the present invention comprises a base, a platform mounted by the base for rotation about a first axis, an ammunition round-holding tray mounted by the platform for rotation about a second axis angularly offset from the first axis, a first driven element fixed to the base, and a second driven element fixed to the tray. The reorienter further comprises a drive train carried by the platform that includes a motor, a drive mechanism coupled to the motor, a first drive element coupled to the first driven element, and a second drive element coupled to the second driven element. The drive mechanism is thus structured to convert input drive of the motor into combined pivotal motions of the tray about the first and second axes to produce tray movement along a spiral path between an ammunition round-receiving orientation and an ammunition round-handoff orientation.

Additional features, advantages, and objectives of the present invention will be set forth in the description which follows and in part will be apparent from the description, or may be learned by practice of the invention. The objects and advantages of the present invention will be realized and attained by the apparatus particularly pointed out in the following written description and the appended claims, as well as in the accompanying drawings.

It will be understood that both the foregoing general description and the following detailed description are exemplary and explanatory and are intended to provide a complete description of the invention as claimed.

The accompanying drawing is intended to provide a further understanding of the invention and is incorporated in and constitutes a part of the specification, illustrates a preferred embodiment of the invention, and, together with the description, explains the principles of the invention.

BRIEF DESCRIPTION OF THE DRAWINGS

Like reference numerals refer to corresponding parts throughout the several views of the drawings.

DETAILED DESCRIPTION OF THE PREFERRED EMBODIMENT

Figure 1:
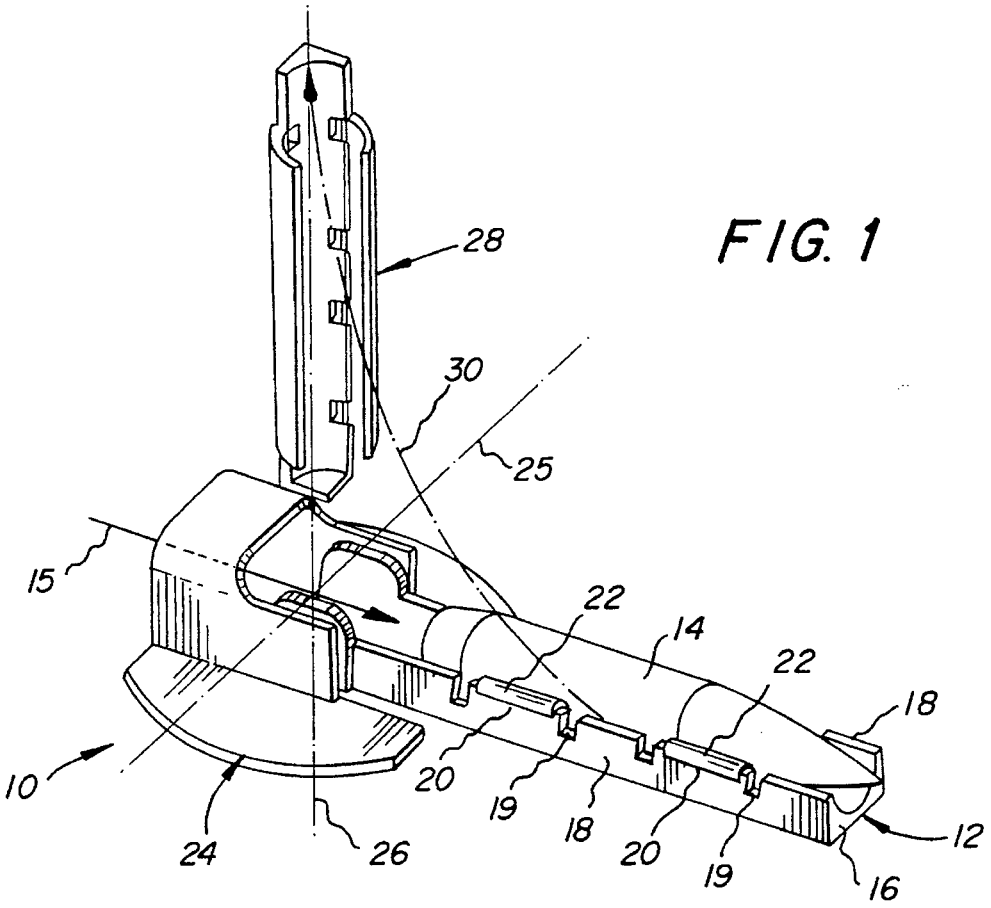
FIG. 1 is a generalized perspective view of an ammunition round reorienter structured in accordance with a preferred embodiment of the present invention.

The ammunition round reorienter in accordance with a preferred embodiment of the present invention is generally indicated at 10 in FIG. 1 and is seen to comprise a tray, generally indicated at 12, for holding a large caliber ammunition round 14 that has been downloaded from a magazine (not shown) and delivered endwise (axially) onto the tray, as indicated by arrow 15. Tray 12 includes a bottom 16 and upstanding sidewalls 18. Vertical slots 19 in the sidewalls create resilient fingers 20 having cylindrical gripping members 22 mounted on their free edges that serve to engage and releasably hold the ammunition round 14 on the tray. One end of the tray is mounted by a platform 24 for pivotal motion in elevation about a horizontal axis 25. Platform 24, in turn, is mounted for rotation in azimuth about a vertical axis 26. As will be described in conjunction with FIGS. 2 and 3, tray 12 is concurrently rotated in azimuth and pivoted in elevation to reorient ammunition round 14 from a horizontal orientation, as received from a magazine, to a vertical orientation, while concurrently angularly reorienting the ammunition round into handoff relation with a loading arm, generally indicated at 28, of an autoloader serving a tank howitzer, not shown. Slots 19 provide access for fingers (not shown) on loading arm 28 acting to transfer the ammunition round 14 from tray 12 to the loading arm. As a result of the concurrent motions of tray 12 about axes 22 and 26, the ammunition round 14 is translated by the tray along a spiral path 30 specially configured to avoid interference with the various static and dynamic structures within the tank hull and turret.

Figure 2:
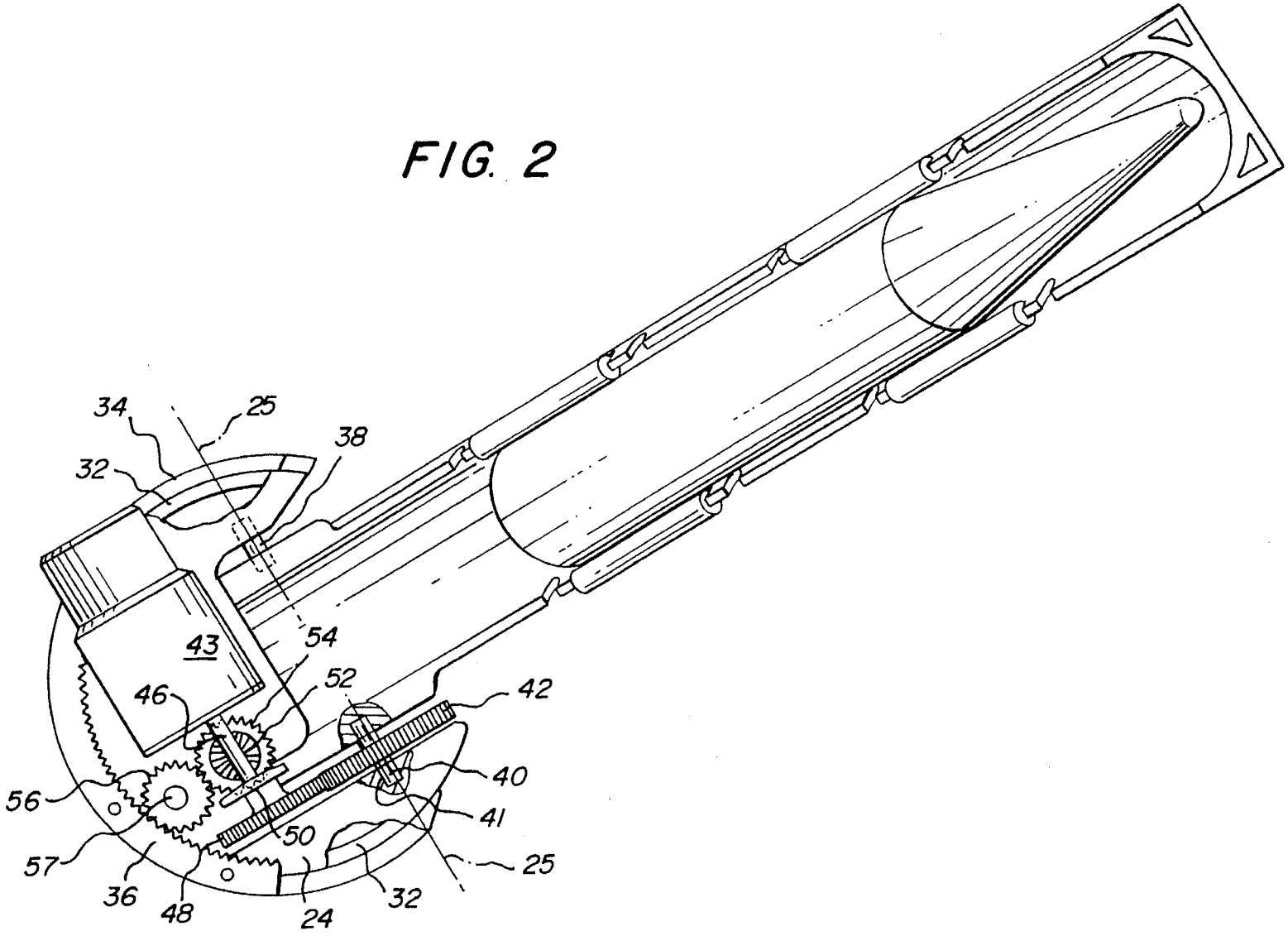
FIG. 2 is an enlarged perspective view showing additional structural details of the reorienter of FIG. 1.

Turning to FIG. 2, platform 24 is seated on a recessed annular track 32 formed on a base 34. This base is typically fixed to a static structural member (not shown) of the tank. The peripheral edge portion of platform 24 is captured in sliding engagement with track 32 by an overhanging sector ring gear 36 fixed to an upper edge of the base 34. The radius of curvature of the annular track 32 is centered on vertical axis 26 (FIGS. 1 and 3), and thus platform 34 is mounted on the base for rotation in azimuth about this vertical axis. The radius of sector ring gear 36 is also centered on the vertical axis.

Tray 12 is pivotally mounted to the platform 24 by a pair of opposed axles 38 and 40 that are coaxial with horizontal axis 25. Axle 40 is fixed to tray 12 at its inner end and rotatably received in a bore 41 drilled in platform 24. A spur gear 42 is fixed on axle 40, such that tray 12 is drivingly connected to this spur gear.

Figure 3:
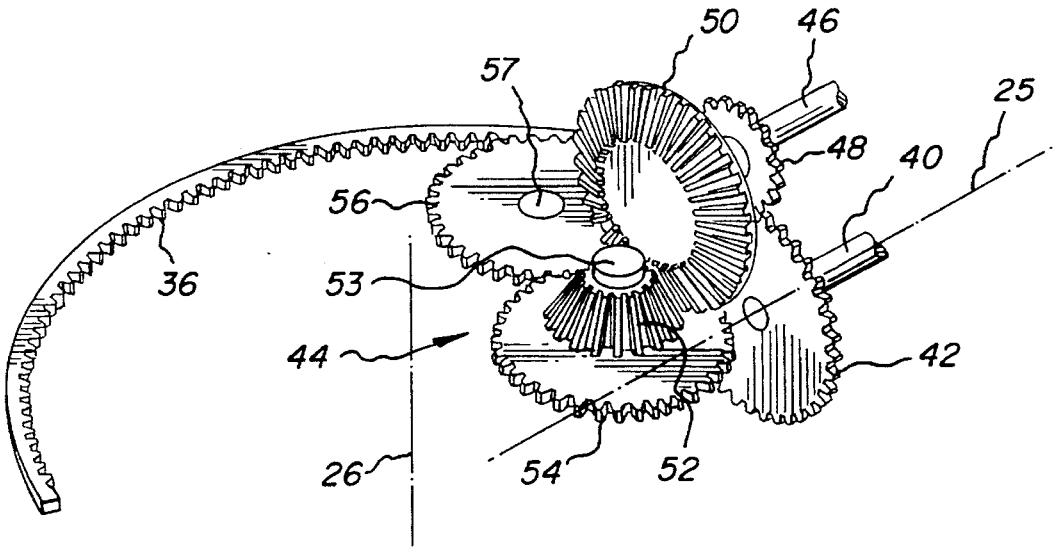
FIG. 3 is an enlarged perspective view of a gear train utilized in the reorienter of FIG. 2.

Platform 24 mounts a drive train that includes a motor 43 and a gearset, which is generally indicated at 44 and best seen in FIG. 3. The output shaft 46 of motor 43 drives a pinion gear 48 that meshes with the spur gear 42 that is drivingly connected to the tray. Consequently, motor 43 is coupled to drive the tray 12 in pivotal motion about horizontal axis 25 and thereby elevate the tray.

Also fixed on the motor output shaft 46 is a bevel gear 50 that meshes with a bevel gear 52 journalled on a vertical shaft 53 fixed at its lower end to platform 24. Also journalled on this vertical shaft 53 in driving connection with bevel gear 52 is a spur gear 54 that meshes with an idler gear 56 journalled on a separate vertical shaft 57, also fixed at its lower end to platform 24. Idler gear 56 also meshes with the sector ring gear 36.

Consequently, motor 43 is coupled to also drive platform 24 in rotation about vertical axis 26 and thereby swing tray 12 in azimuth.

It will be appreciated that the ratios of the gears in the parallel drive paths between motor 43 and sector ring gear 36 and between the motor and spur gear 42 are selected to achieve the desired relationship of the angular velocities of the ammunition round as it is concurrently moved in azimuth and elevation and thus define the requisite configuration of ammunition round reorientation path 30 (FIG. ). While in the disclosed embodiment, the ammunition round is pivoted 90° in elevation and rotated 90° in azimuth to assume the requisite handoff position with loading arm 28, it will be appreciated that the magnitudes of these angles may be readily varied, as required for a particular installation, by changing the gear ratios in the two parallel drive paths and/or the energization periods of motor 43 required to drive ammunition reorienter 10 through reorienting and return half-cycles of a full operating cycle.

It will also be appreciated that, rather than a gear drive mechanism, other drive mechanisms utilizing, for example, fluidic components, or cams and cam followers may be adapted to achieve the concurrent, dual reorienting motions of the ammunition round-holding tray in elevation and azimuth as it is driven between an ammunition round-receiving orientation and ammunition round-handoff orientation.

It will be apparent to those skilled in the art that various modifications and variations can be made in the ammunition magazine of the present invention without departing from the spirit of the present invention. Thus, it is intended that the present invention cover modifications and variations thereof, provided they come within the spirit of the present invention. Thus, it is intended that protection for the present invention extend to modifications and variations thereof, provided they come within the scope of the appended claims and equivalents thereof.

What is claimed is:

1. An ammunition round reorienter comprising, in combination:

a base;

a platform mounted by the base for rotation about a first axis;

an ammunition round-holding tray mounted by the platform for rotation about a second axis angularly offset from the first axis;

a first gear fixed to the base;

a second gear fixed to the tray; and a drivetrain carried by the platform, the drivetrain including:

a motor, and a gear set meshing with the first and second gears to convert input drive from the motor to combined rotational motions of the tray about the first and second axes along a desired path.

2. The ammunition round reorienter defined in claim 1, wherein the gear set includes a pair of intermeshing bevel gears.

3. The ammunition round reorienter defined in claim 1, wherein the gear set includes a first drive path between the motor and the first gear having a first gear ratio and a second drive path between the motor and the second gear having a second gear ratio, the first and second gear ratios determining the desired path.

4. The ammunition round reorienter defined in claim 3, wherein the first gear is a ring gear fixed to the base in a position centered on the first axis, and the second gear is a spur gear fixed to the tray in a position centered on the second axis.

5. The ammunition round reorienter defined in claim 4, wherein the first axis is a vertical axis, and the second axis is a horizontal axis.

6. The ammunition round reorienter defined in claim 1, wherein the motor includes an output shaft having a drive axis to parallel to one of the first and second axes, and wherein the gear set includes 1) a pinion gear and a first bevel gear keyed on the output shaft, the pinion gear gear-connected to one of the first and second gears, and 2) a second bevel gear and a spur gear keyed on an axle parallel to the other of the first and second axes, the second bevel gear intermeshing with the first bevel gear and the spur gear gear-connected to the other of the first and second gears.

7. The ammunition round reorienter defined in claim 6, wherein the first axis is vertically oriented, and the second axis is horizontally oriented.

8. The ammunition round reorienter defined in claim 7, wherein the first gear is a ring gear fixed to the base in a position centered on the first axis, and the second gear is a spur gear fixed to the tray in a position centered on the second axis.

9. The ammunition round reorienter defined in claim 6, wherein the drive shaft is parallel to the second axis and the axle is parallel to the first axis.

10. The ammunition round reorienter defined in claim 6, wherein the pinion gear directly intermeshes with the second gear, and the spur gear is gear-connected to the first gear by an idler gear.

11. An ammunition round reorienter comprising, in combination:

a base;

a platform mounted by the base for rotation about a first axis;

an ammunition round-holding tray mounted by the platform for rotation about a second axis angularly offset from the first axis;

a first driven element fixed to the base;

a second driven element fixed to the tray; and a drive train carried by the platform, the drive train including:

a motor, and a drive mechanism coupled to the motor and including a first drive element coupled to the first driven element and a second drive element coupled to the second driven element, the drive mechanism converting input drive of the motor into combined pivotal motions of the tray about the first and second axes to produce tray movement along a spiral path between an ammunition round-receiving orientation and an ammunition round-handoff orientation.

12. An ammunition round reorienter comprising, in combination:

a base;

a platform mounted by the base for rotation about a first axis;

an ammunition round-holding tray mounted by the platform for rotation about a second axis angularly offset from the first axis; and a drive system commonly coupled to rotate the platform about the first axis and concurrently to pivot the tray about the second axis, whereby to translate the tray between an ammunition round-receiving orientation and an ammunition round-handoff orientation.

13. The ammunition round reorienter defined in claim 12, wherein the drive systems includes a motor coupled to deliver power over parallel drive paths to the platform and the tray.

14. The ammunition round reorienter defined in claim 13, wherein the motor is mounted by the platform.

* * * * *